US006322456B1

(12) United States Patent
Benggon

(10) Patent No.: US 6,322,456 B1
(45) Date of Patent: Nov. 27, 2001

(54) GOLF SWING GUIDE

(76) Inventor: Baldwin A Benggon, 250 E. Moody Ave., Fresno, CA (US) 93720

( * ) Notice: Subject to any disclaimer, the term of this patent is extended or adjusted under 35 U.S.C. 154(b) by 0 days.

(21) Appl. No.: 09/491,466

(22) Filed: Jan. 26, 2000

(51) Int. Cl.[7] ..... A63B 57/00; A63B 69/36
(52) U.S. Cl. ..... 473/219; 473/259; 473/227
(58) Field of Search ..... 473/258–261, 473/264, 215–223, 229, 231, 266, 271, 275–277, 409; 273/317.2, 108.2; D21/789, 791

(56) References Cited

U.S. PATENT DOCUMENTS

| | | | | |
|---|---|---|---|---|
| 4,758,000 | * | 7/1988 | Cox | 473/227 |
| 4,852,881 | * | 8/1989 | Bellagamba et al. | 473/259 |
| 4,949,974 | * | 8/1990 | Bellagamba | 473/259 |
| 5,439,225 | * | 8/1995 | Gvoich et al. | 473/259 |
| 5,816,932 | * | 10/1998 | Alexander | 473/259 |
| 5,984,798 | * | 11/1999 | Gilmour | 473/259 |

* cited by examiner

*Primary Examiner*—Jeanette Chapman
*Assistant Examiner*—Mitra Aryanpour
(74) *Attorney, Agent, or Firm*—Michael I Kroll

(57) ABSTRACT

A golf swing guide for aiding a golfer in correcting flaws in swinging a golf club. The golf swing guide includes a base, a guide track defining a swing path along which the golfer is to swing the golf club and a device for pivotally connecting the guide track to the base for adjusting the guide track to a size of the golfer. A device for retaining the back of the golfer in a proper position with respect to the guide track is positioned to extend along a small of the back of the golfer whereby the golfer is positioned within the base with the torso extending through the guide track during swinging of the golf club. The device for pivotally connecting includes a first pivotal support pole connected between a front of the base and the guide track and a second support bar pivotally connected to a back of the base and the guide track. When the first pivotal support pole is pivoted, the second support pole pivots about the back of the base causing an angle of extension of the guide track to change. A device for aligning the legs of the golfer within the base is connected between the left and right side of the base and is movable along a length of the base. A weight shift indicator is pivotally attached to the base for use in observing the weight shift of the golfer during a swing.

10 Claims, 4 Drawing Sheets

GOLF SWING GUIDE

BACKGROUND OF THE INVENTION

1. Field of the Invention

The present invention relates generally to a device for guiding the swing of a golf club and, more specifically, to a device for teaching a golfer the proper swing path and plane in which to swing a golf club and the proper weight shift during the swing while maintaining the proper bodily position throughout the swing.

2. Description of the Prior Art

Numerous types of devices for aiding the swing of a golfer have been provided in the prior art. For example, U.S. Pat. Nos. 1,567,530; 3,583,707; 5,026,065; 5,330,192 and 5,429,367 all are illustrative of such prior art. While these units may be suitable for the particular purpose to which they address, they would not be as suitable for the purposes of the present invention as heretofore described.

A device for exercising and training a person to make proper swings and strokes in playing golf The device includes a circular track, a slide upon the track and a swiveled ring carried by the slide. A golf club is received by the ring. When the golf club is swung by a golfer, the club, ring and slide are caused to move around the track causing the golfer to move in the proper manner during the swing.

A golf training device having a circular track loop along which a golf club is swung and which is adjustable in height and angle to a trainee and his club. The loop is supported on vertically adjustable stanchions provided at the ends of a semicircular base member. Diametrically opposed stop collars on the loop are pivotally secured to the upper ends of the stanchions. Slotted adjustable plates are bolted to the stanchions and pivotally secured to the loop.

A golf training apparatus has a frame and a golf club swing guide attached to the frame for guiding a person's swing of a golf club. A simplified guide adjustment system allows for basic telescoping frame members to be used in the adjustment of the position of the first golf club swing guide as to both height and tilt of the guide. The frame and swing guides are made of a PVC (or polyethylene) pipe. Adjustments are made by telescoping the frame members and swing guide support members to the desired position and locking them in place. The frame has a single pair of vertical frame members attached to the base and open at the base for inserting over a pair of ground anchor posts to prevent movement of the golf training apparatus during practice swings because of its lightweight.

A golf trainer has a continuous hoop formed by curved angle iron circular segments which are interconnected with short angle iron connector segments. The major segments have forward-extending flanges which, when joined together, form one continuous forward edge. A plastic wear strip with a U shape is pressed over the continuous edge of the joined flanges to form a continuous plastic wear strip for guiding the shaft of a golf club. The hoop has four lugs which extend rearward, joining two anchor adjustments. A base rod has U-shaped feet formed at front and rear ends. A front end which terminates upwardly in a front loop is connected to a lower lug. A rear end of the base rod extends upwardly to a rear loop. A lower adjustment rod has a lower loop which connects to the rear loop. An upper adjustment rod has an upper loop which connects to an upper lug. Sliders connected to an upper end of the lower adjustment rod receive a lower end of the upper adjustment rod. A bolt with a hand knob is threaded into one of the sliders to secure the slider in a fixed position to the upper rod. The front loops hold the bottom of the hoop above the ground, and the adjustment rods fix the angle of the hoop. A golfer grooves his swing by standing in the hoop and guiding a heel area of his club shaft along the plastic wear strip at the front of the hoop.

A golf trainer has a continuous hoop formed by curved angle iron or PVC extruded circular segments which are interconnected with short angle iron or steel connector segments. The major segments have forward-extending flanges which, when joined together, form one continuous forward edge. A plastic wear strip with a U shape is pressed over the continuous edge of the joined flanges to form a continuous plastic wear strip for guiding the shaft of a golf club. The hoop has removable lugs which extend rearward, joining two anchor adjustments. A base rod has U-shaped feet formed at front and rear ends. A front end which terminates upwardly in a front loop is connected to a lower lug. A rear end of the base rod extends upwardly to a rear loop. A lower adjustment rod has a lower loop which connects to the rear loop. An upper adjustment rod has an upper loop which connects to an upper lug. Sliders connected to an upper end of the lower adjustment rod receive a lower end of the upper adjustment rod. A bolt with a hand knob is threaded into one of the sliders to secure the slider in a fixed position to the upper rod. The front loops hold the bottom of the hoop above the ground, and the adjustment rods fix the angle of the hoop. A golfer grooves his swing by standing in the hoop and guiding a heel area of his club shaft along the plastic wear strip at the front of the hoop.

SUMMARY OF THE PRESENT INVENTION

The present invention relates generally to a device for guiding the swing of a golf club and, more specifically, to a device for teaching a golfer the proper swing path and plane in which to swing a golf club and the proper weight shift during the swing while maintaining the proper bodily position throughout the swing.

A primary object of the present invention is to provide a golf swing guide that will overcome the shortcomings of prior art devices.

Another object of the present invention is to provide a golf swing guide which is able to guide the swing of a golfer through the proper swing path and plane.

A further object of the present invention is to provide a golf swing guide which is able to maintain the golfers hips in a position square to the ball upon impact with the ball.

A yet further object of the present invention is to provide a golf swing guide which includes a selectively movable bar connected to a base of the guide for properly aligning the feet of the golfer.

An even further object of the present invention is to provide a golf swing guide including a protrusion extending from the movable bar for maintaining a position of the back leg of the user during a golf swing.

A still further object of the present invention is to provide a golf swing guide including a back alignment bar for properly aligning the body of the golfer.

An even further object of the present invention is to provide a golf swing guide which is able to adapt for use by users of all sizes.

A further object of the present invention is to provide a golf swing guide having a pivotal bar positioned in front of the user for setting a limit point for movement of the front leg of the user during a swing of the golf club.

Another object of the present invention is to provide a golf swing guide that is simple and easy to use.

A still further object of the present invention is to provide a golf swing guide that is economical in cost to manufacture.

Additional objects of the present invention will appear as the description proceeds.

A golf swing guide for aiding a golfer in correcting flaws in swinging a golf club is disclosed by the present invention. The golf swing guide includes a base, a guide track defining a swing path along which the golfer is to swing the golf club and a device for pivotally connecting the guide track to the base for adjusting the guide track to a size of the golfer. A device for aligning the position of the back of the golfer with respect to the guide track whereby the golfer is positioned within the base with the torso extending through the guide track during swinging of the golf club. The device for pivotally connecting includes a first vertically adjustable support pole connected between a front of the base and the guide track and a second support bar is pivotally connected to a back of the base and the guide track. When the first vertically adjustable support pole is adjusted in a vertical direction, the second support pole pivots about the back of the base causing an angle of extension of the guide track to change. A device for aligning the legs of the golfer within the base is connected between the left and right side of the base and is movable along a length of the base. A weight shift indicator is pivotally attached to the base for use in observing the weight shift of the golfer during a swing.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims. dr

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
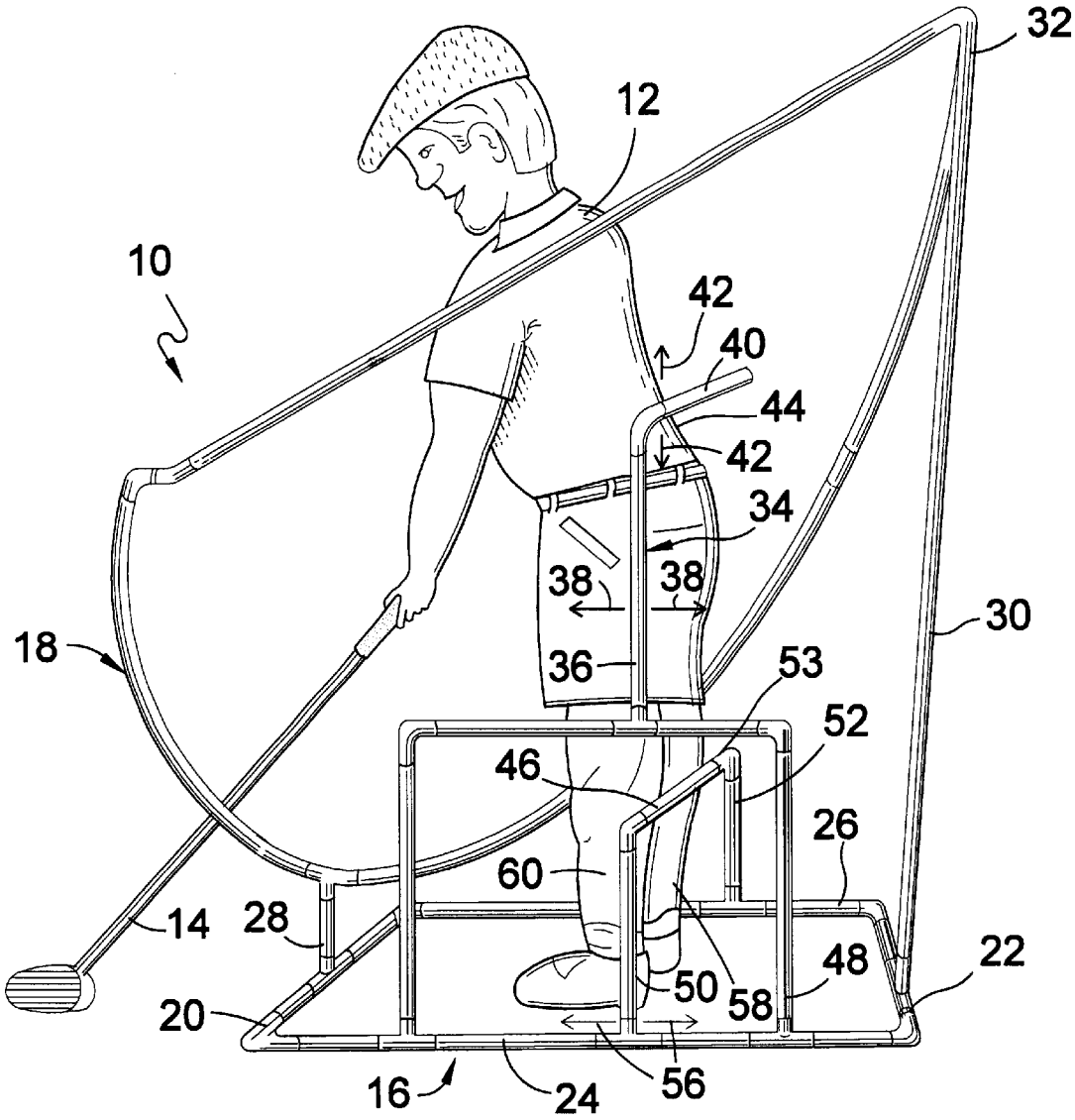
FIG. 1 is a side perspective view of the golf swing guide of the present invention with a golfer positioned within the guide and preparing to swing of a golf club.

Turning now descriptively to the drawings, in which similar reference characters denotes similar elements throughout the several views, the Figures illustrate the golf swing guide of the present invention. With regard to the reference numerals used, the following numbering is used throughout the various drawing figures.

10 golf swing guide of the present invention
12 golfer
14 golf club
16 base
18 guide track
20 front bar of base
22 back bar of base
24 left side bar of base
26 right side bar of base
28 first vertical support pole connecting front side bar to guide track
30 second vertical support pole connecting back side bar to guide track
32 connection point between second vertical support pole and back bar
34 back side alignment device
36 vertically extending bar
38 arrows indicating horizontal movement of vertically extending bar
40 horizontal bar
42 arrows indicating height adjustment of horizontal bar
44 small of back of user
46 leg alignment bar
48 weight shift indicator bar
50 first side bar
52 second side bar
53 cross bar
54 protruding bar
55 arrow indicating movement of protruding bar along length of cross bar
56 arrows indicating direction of movement of leg alignment bar
58 back leg
60 front leg
62 arrow indicating direction of pivot of the weight shift indicator bar.

DETAILED DESCRIPTION OF THE PREFERRED EMBODIMENT

Turning now descriptively to the drawings, in which similar reference characters denote similar elements throughout the several views, FIGS. 1 through 4 illustrate the golf swing guide of the present invention indicated generally by the numeral 10.

The golf swing guide 10 is shown in FIG. 1 with a golfer 12 positioned therein and holding a golf club 14. The golf swing guide 10 includes a base 16 and a guide track 18. The base 16 is preferably in the shape of a quadrilateral including a front bar 20, a back bar 22, a left side bar 24 and a right side bar 26. The guide track 18 forms an arc completing substantially three-quarters of a circle, with the ends of the arc being connected. The arc defines a path for the swing of the golf club 14 from the back swing through the follow through, thereby guiding the user 12 throughout the entire swing.

A first vertical support pole 28 extends from and is substantially perpendicular to the front bar 20 engaging a base of the guide track 18. The first vertical support pole 28 is pivotally connected to the guide track 18 allowing the angle of the guide track 18 to be adjusted. A second vertical support pole 30 is pivotally connected to and extends from the back bar 22, engaging a top side of the guide track 18 at a connection point 32. The second vertical support pole 30 is caused to pivot about the back bar 22 when the first vertical support pole 28 is pivoted.

Detachably connected to and extending between the left and right side bars 24 and 26 is a leg alignment bar 46. The leg alignment bar 46 is slideable along the length of the left and right side bars 24 and 26 as indicated by the arrows labeled with the numeral 56. The position of the leg alignment bar 46 being dependent upon the size of the user 12, the type of stroke desired to be practiced and the club being used to practice the stroke.

The leg alignment bar 46 is positioned to extend perpendicular to the base 16 with the calves of the user 12 positioned in contact therewith. The leg alignment bar 46 includes first and second side bars 50 and 52 extending vertically from the left and right side bars 24 and 26, respectively. A cross bar 53 extends between the first and second side bars 50 and 52. Extending from the cross bar 53 is a protruding bar 54. The protruding bar 54 extends perpendicular to the cross bar 53 and parallel to the base 16. The protruding bar 54 is able to move along the length of the cross bar 53 as indicated by the arrows labeled with the numeral 55. The protruding bar 54 receives the side of the back leg 58 of the user 12. The position of the leg alignment bar 46 is dependent on the size of the user and the type of swing to be practiced.

Detachably connected to the left side bar 24 is a weight shift indicator bar 48. The weight shift indicator bar 48 is pivotally connected to the left side bar 24 and sets a limit point for movement of the golfer's lead leg during weight shift occurring when swinging the golf club 14. The position of the weight shift indicator bar 48 is dependent on the size of the golfer 12, the type of stroke being practiced and the type of golf club being used.

Extending from a top of the weight shift indicator bar 48 is a back side alignment device 34. The back side alignment device 34 is detachably connected to the weight shift indicator bar 48 and includes a vertical bar 36 extending from and movable along a length of the weight shift indicator bar 48. The vertical bar 36 is pivotally connected to the weight shift indicator bar 48 to thereby maintain a position perpendicular to the base 16. The movement of the vertical bar 36 along the length of the top side of the weight shift indicator bar 48 is indicated by the arrow labeled with the numeral 38. A horizontal bar 40 extends from an end of the vertical bar 36 opposite the connection to the weight shift indicator bar 48. The height of the horizontal bar 40 is adjustable as indicated by the arrows labeled with the numeral 42. The height of the horizontal bar 40 is adjusted during use according to the height of the user 12. The horizontal bar 40 is preferably positioned to extend along the small of the back 44 of the user 12.

Figure 2:
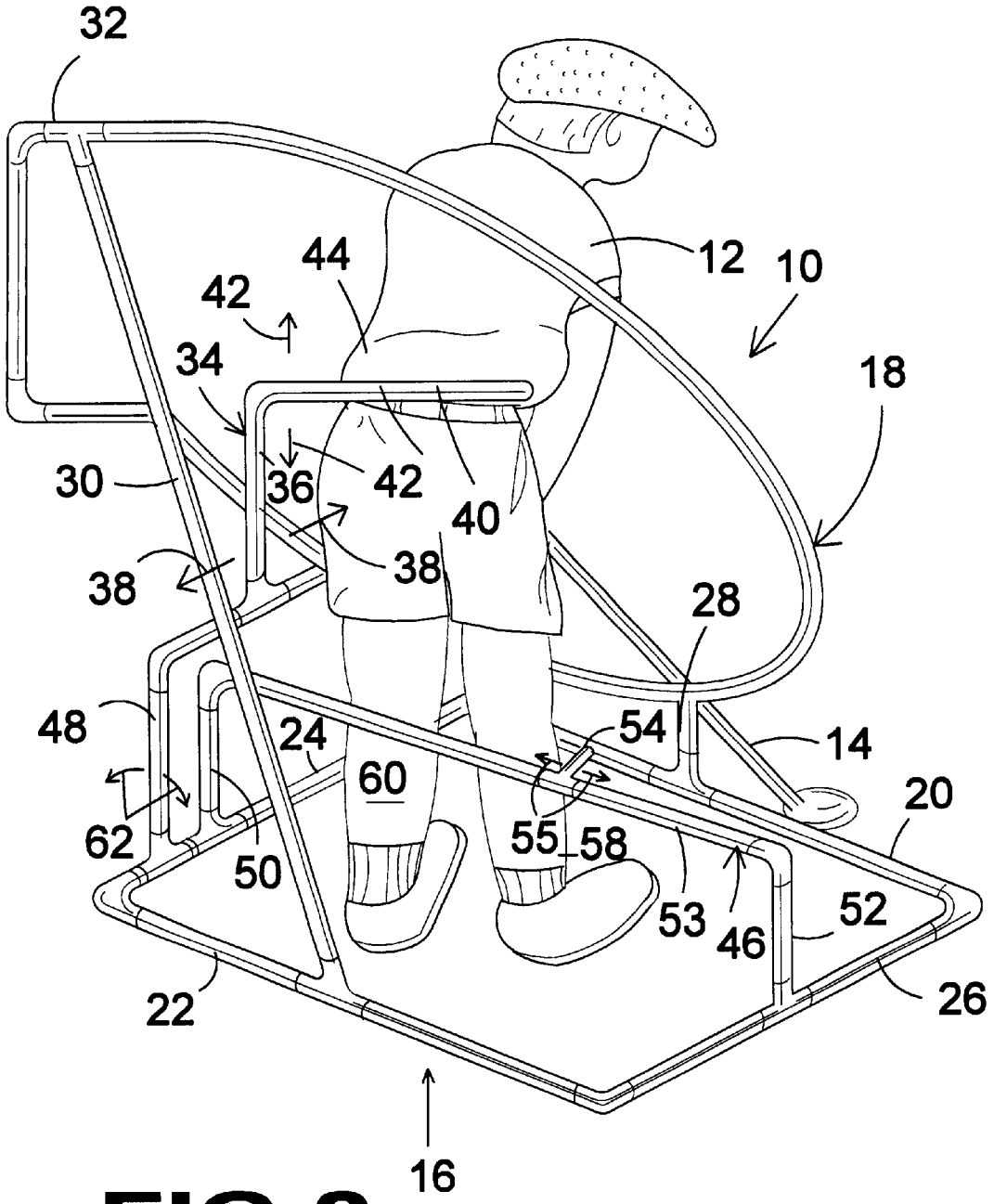
FIG. 2 is a back perspective view of the golf swing guide of the present invention with a golfer positioned within the guide and preparing to swing of a golf club.

A back view of the golf swing guide 10 is shown in FIG. 2. From this view the position of each element of the golf swing guide 10 is viewed with respect to the position of the golfer 12 during a swing of the golf club 14. As can be seen in this figure, the golfer 12 is positioned with the horizontal bar 40 positioned against the small of the back 44 of the user 12. The leg alignment bar 46 is positioned against the calves of the golfer's legs 58 and 60 with the protruding bar 54 positioned against a side of the back leg 58 of the golfer 12. The weight shift indicator bar 48 is secured in position to set a position for maximum of movement of the front leg 60 of the user during the swing.

Figure 3:
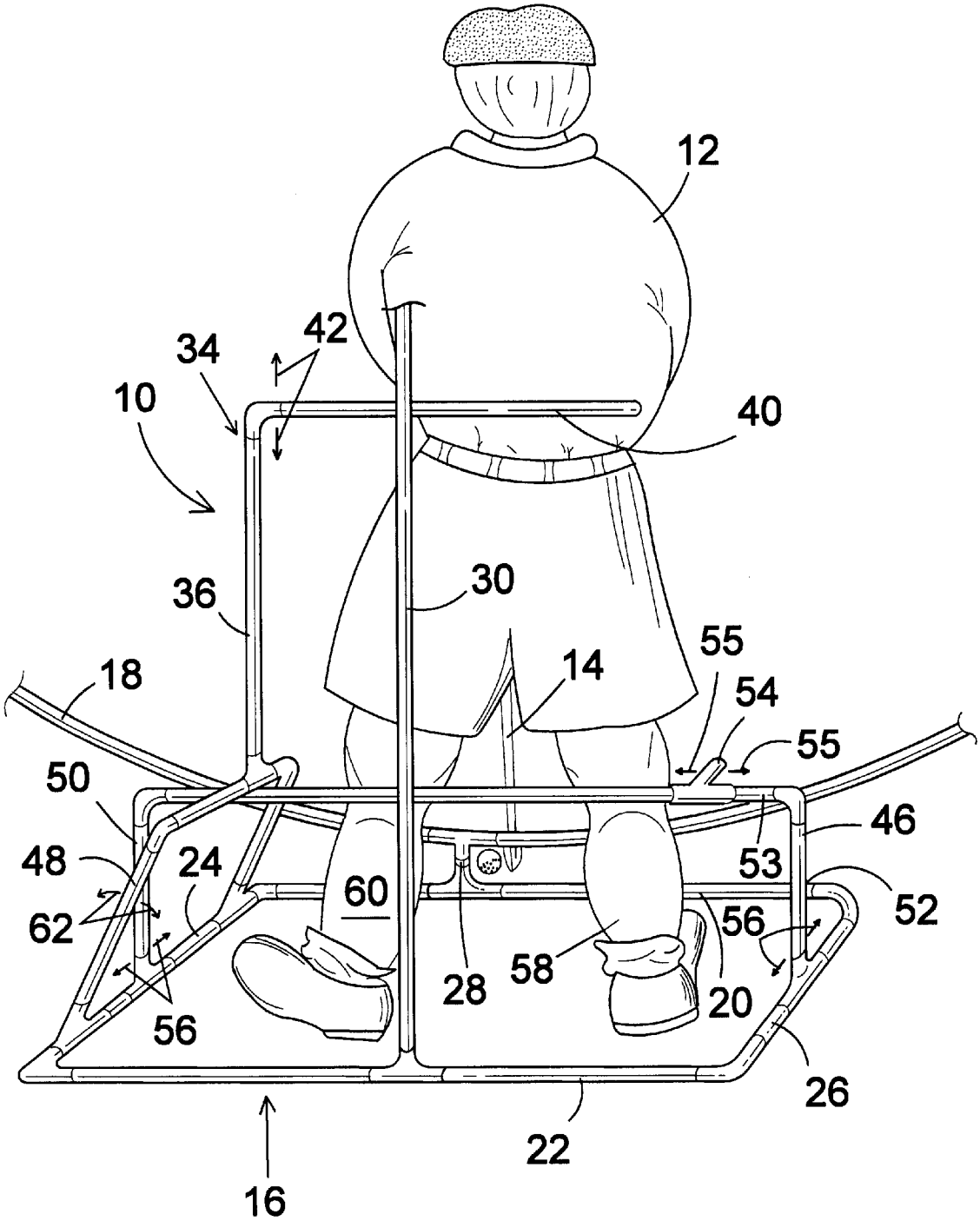
FIG. 3 is a back perspective view of the golf swing guide of the present invention showing the pivoting of the leg bar and back bar at a point of impact with a golf ball.
Figure 4:
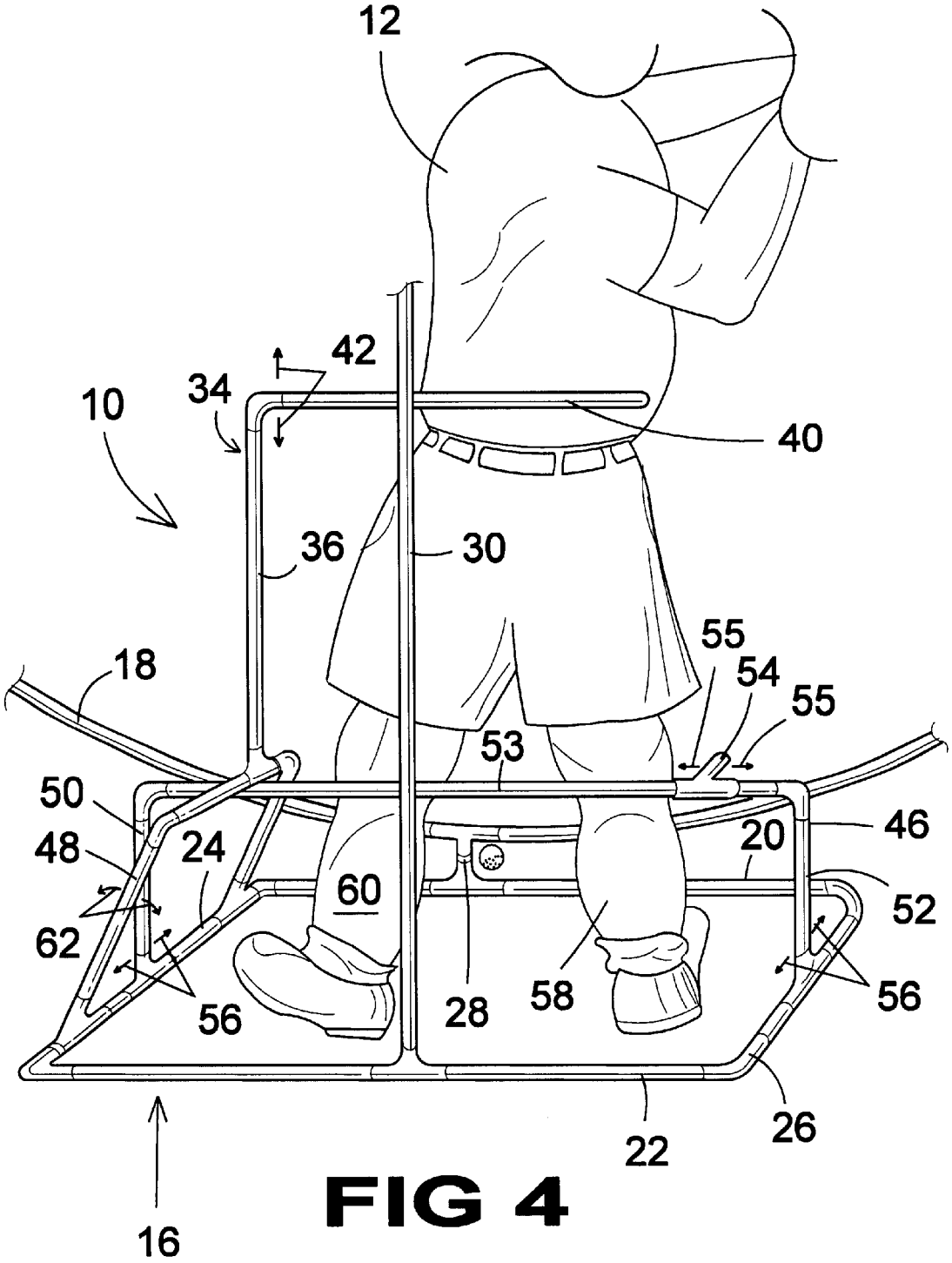
FIG. 4 is a back perspective view of the golf swing guide of the present invention showing the pivoting of the leg bar and back bar upon beginning of a swing of a golf club.

A view of a golfer 12 using the golf swing guide 10 at different points during a golf swing are shown in FIGS. 3 and 4. FIG. 3 illustrates a golf swing at a point of impact with the golf ball. At this point the weight of the user's body has shifted from being totally on the back leg 58 of the user to a centered point evenly distributed between the back leg 58 and front leg 60 of the user. The weight shift indicator bar 48 is positioned in front of the front leg 60 of the golfer 12 and sets the position at which the front leg 60 can move to upon completion of the swing as the golfer 12 shifts the weight of the body from the back leg 58 to the front leg 60. Throughout the swing the leg alignment bar 46 is positioned against the calves of the golfer's legs 58 and 60. The leg alignment bar 46 is secured in position to prevent the legs of the golfer 12 from moving backwards.

The beginning of the swing of the golf club 14 is illustrated in FIG. 4. As can be seen in this figure, the golfer 12 is preparing to move the arms to thereby bring the golf club down along the path defined by the guide track 18. Throughout this movement, the golf club 14 should follow the path defined by the guide track 18. When in this position, the leg alignment bar 46 is positioned against the calves of the legs of the golfer 12, the horizontal bar 40 is positioned against the small of the back of the golfer 12 and the weight shift indicator bar 48 is positioned in front of and slightly spaced from the front leg 60 of the golfer 12. When swinging the golf club 14, the weight of the golfer's body is caused to shift from totally atop the back leg 58 through the golfer's body and on to the front leg 60. At the point of the swing illustrated in FIG. 4, the weight of the golfer's body is about to shift off of the back leg 58. As the weight shifts to the front leg 60 the front leg 60 is caused to straighten towards a perpendicular relationship with the ground and thus pivot towards the weight shift indicator bar 48. The weight shift indicator bar 48 sets a position for maximum forward movement of the front leg 60 of the golfer 12.

The operation of the golf swing guide 10 will now be described with reference to the figures. In operation, the golf swing guide 10 must be adjusted to meet the size and physical dimensions of the user. This is done by adjusting the angle of the first vertical support pole 28 thereby causing the second vertical support pole 30 pivot therewith through the pivotal connection 32 with the guide track 18. This will adjust the guide track 18 for aiding in the practice of the desired type of golf swing. The height of the horizontal bar 40 is then adjusted to be positioned against the small of the back of the golfer 12.

The leg alignment bar 46 is then moved along the length of the left and right bars 24 and 26, respectively, of the base 16 to adjust the position of the feet of the golfer 12. The leg alignment bar 46 will set the distance the golfer 12 stands from the golf ball and should be positioned to contact the calves of the golfer 12 throughout the swing. The protruding bar 54 will then be moved along the length of the cross bar 53 to set the distance behind the golf ball the golfer 12 will stand. The weight shift indicator bar 48 must also be pivoted to set the position at which the front leg 60 of the golfer 12 can move during the golf swing.

Once the golf swing guide 10 is aligned properly, the golfer 12 will move into position within the base 16 and prepare for practicing the swing. The golfer's calves are now positioned against the leg alignment bar 46 with the side of the back leg 58 of the golfer 12 positioned against the protruding bar 54. The horizontal bar 40 is positioned against the small of the back of the golfer. The weight shift indicator bar 48 is positioned in front of the front leg 60 of the golfer 12. The golfer 12 is now ready to practice the swing.

The golfer 12 will now begin the back swing bringing the golf club 14 back past the back leg 58 and behind the back, shifting all the weight of the body onto the back leg 58. This will cause the front leg 60 to angle back towards the back leg 58 and further away from the weight shift indicator bar 48. The golfer 12 will now begin the swing of the golf club 14 by guiding the golf club 14 along the path defined by the guide track 18. While the golfer 12 is swinging the golf club 14 along the path, the weight of the golfer's body will shift from the back leg 58 to a centered position evenly distributed between the front leg 60 and the back leg 58. At this point the golf club 14 should be midway through the swing and at a point of contact for hitting the ball. Furthermore, the shift in weight has caused the front leg to pivot and thereby straighten up with respect to the ground and closer to the weight shift indicator bar 48.

After striking the ball the golfer 12 will continue the follow through of the stroke, pulling the golf club 14 past the front leg 60 and around the remainder of the body. The weight of the body of the golfer 12 will continue to shift until the weight is totally on the front leg 60 of the golfer 12, the front leg 60 moving towards the weight shift indicator bar 48 as it straightens out and the weight of the golfer's body is shifted thereto. Throughout the entire swing the protruding bar 54 is positioned against the side of the back leg of the golfer and the leg alignment bar 46 is positioned against the calves of the legs of the golfer 12.

Faults in the swing of a golfer 12 can thus be analyzed and corrected by the golf swing guide 10 of the present invention. The position of the golfer 12 is partially controlled by retaining certain parts of the golfer's body in an optimal swing position, e.g. holding the small of the back against the horizontal bar 40, the calves against the leg alignment bar 46 and the side of the back leg 60 against the protruding bar 54. The swing and weight shift can then be observed as the golf club 14 moves along the path defined by the guide track 18. The final position of the front leg 60 can be analyzed based upon its final position with respect to the weight shift indicator bar 48. If the front leg 60 does not contact the weight shift indicator bar 48 then it is evident that the golfer 12 must practice transferring the weight from the back leg to the front leg during the swing. If the golf club 14 does not precisely follow the path defined by the guide track 18 then it is evident that the golfer 12 must practice keeping the golf club 14 steady throughout the swing and practice on achieving a more fluid and direct swing towards the golf ball. The curvature of the arc defining the guide track 18 also provides the golfer 12 with optimal limit points for the back swing and follow through of the swing. The leg alignment bar 46 and the protruding bar 54 maintain the back leg of the golfer 12 in the correct position and movement of the legs against the leg alignment bar 46 and the protruding bar 54 is readily detected for additional analysis.

From the above description it can be seen that the golf swing guide of the present invention is able to overcome the shortcomings of prior art devices by providing a golf swing guide which is able to guide the swing of a golfer through the proper swing path and plane and maintain the golfers hips in a position square to the ball upon impact with the ball. The golf swing guide includes a selectively movable bar connected to a base of the guide for properly aligning the feet of the golfer, a device for aligning the body of the golfer in the proper position, and a weight shift alignment bar for analyzing the weight shift to the front leg of the user during a swing of the golf club. The golf swing guide is also adjustable to adapt for use by users of all sizes. Furthermore, the golf swing guide of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A golf swing guide for aiding a golfer in correcting flaws in the swing of a golf club, said golf swing guide comprising:

a) a base section;

b) a guide track defining a swing path along which the golfer is to swing the golf club;

c) means for connecting said guide track to said base section wherein said means for connecting is adjustable to pivot said guide track and adjust said guide track to a size of the golfer; and d) means for retaining the back of the golfer in a proper position with respect to said guide track, wherein said golfer is positioned within said base section and extending through said guide track during swinging of the golf club.

2. The golf swing guide as recited in claim 1, wherein said base section includes a front bar and a back bar and said means for pivotally connecting includes a first pivotal support pole connected between said front bar and said guide track and a second support bar pivotally connected to said back bar and said guide track, wherein when said first pivotal support pole is pivoted, said second support pole is caused to pivot about said second bar causing an angle of extension of said guide track to change.

3. The golf swing guide as recited in claim 1, wherein said base section includes a left side bar and a right side bar and said golf swing guide further comprises a means for aligning legs of the golfer within the base, said leg alignment means being connected between said left and right side bars and movable along a length of said left and right side bars.

4. The golf swing guide as recited in claim 3, further comprising a protruding bar extending from and movable along a length of said means for aligning the legs, wherein said protruding bar provides a limit position for a back leg of the golfer.

5. The golf swing guide as recited in claim 1, further comprising a weight shift indicator bar pivotally connected to one of said left and right side bars, said weight shift indicator bar being positioned in front of a front leg of the golfer for setting a limit position for forward movement of the front leg of the golfer.

6. The golf swing guide as recited in claim 4, further comprising a weight shift indicator bar pivotally connected to one of said left and right side bars, said weight shift indicator bar being positioned against a front leg of the golfer and pivoting with movement of the front leg of the golfer during a swing of the golf club for analyzing weight shift of the golfer during the swing.

7. The golf swing guide as recited in claim 1, wherein said means for retaining includes:

a) a vertical bar pivotally connected to said weight shift indicator bar, said vertical bar maintaining a vertical position when said weight shift indicator bar is pivoted; and b) a horizontal bar extending from a side of said vertical bar opposite said connection to said weight shift indicator bar, said horizontal bar being positioned against a small of a back of the golfer during use of said golf swing guide.

8. The golf swing guide as recited in claim 7, wherein said horizontal bar is vertically adjustable for adjusting said golf swing guide.

9. The golf swing guide as recited in claim 1, wherein said guide track is in the form of an arc.

10. The golf swing guide as recited in claim 9, wherein said arc extends substantially 270°.

* * * * *